US007367618B2

(12) United States Patent
Rossini

(10) Patent No.: US 7,367,618 B2
(45) Date of Patent: May 6, 2008

(54) WIRELESS MOUSE AND KEYBOARD CHAIR MOUNT APPARATUS

(76) Inventor: Alfred P. Rossini, 1 Wyndemere Dr., Southborough, MA (US) 01772

( * ) Notice: Subject to any disclaimer, the term of this patent is extended or adjusted under 35 U.S.C. 154(b) by 0 days.

(21) Appl. No.: 11/623,140

(22) Filed: Jan. 15, 2007

(65) Prior Publication Data

US 2007/0164589 A1 Jul. 19, 2007

Related U.S. Application Data

(60) Provisional application No. 60/759,235, filed on Jan. 13, 2006.

(51) Int. Cl.
*A47B 83/02* (2006.01)

(52) U.S. Cl. ..... 297/188.18; 297/188.17; 297/153

(58) Field of Classification Search ..... 297/145, 297/153, 188.15, 188.17, 188.18
See application file for complete search history.

(56) References Cited

U.S. PATENT DOCUMENTS 2,489,861 A * 11/1949 Ciraolo ..... 297/145
2,518,381 A * 8/1950 Runkles ..... 297/145
3,606,449 A * 9/1971 Whybrew et al. ..... 297/115
4,591,206 A * 5/1986 Pribble ..... 297/148
4,668,010 A * 5/1987 Fujiwara ..... 297/150
5,372,403 A * 12/1994 Puerto ..... 297/188.17
6,027,165 A * 2/2000 Adkins ..... 297/188.18
6,827,405 B1 * 12/2004 Roberts ..... 297/411.23
6,923,517 B2 * 8/2005 Yamamoto ..... 312/332
2003/0071497 A1 * 4/2003 Ballendat ..... 297/145

* cited by examiner

*Primary Examiner*—Peter R. Brown
(74) *Attorney, Agent, or Firm*—Brian M. Dingman; Mirick, O'Connell, DeMallie & Lougee, LLP

(57) ABSTRACT

An apparatus for supporting a tray on a chair having two arms. The apparatus includes a first support member coupled to a first arm of the chair, the first support member defining a top surface and being adapted to be slid from a use position in which the top surface is substantially accessible to support the tray, to a stowed position in which the top surface is not substantially accessible to support the tray, and a second support member coupled to a second arm of the chair, the second support member defining a top surface and being adapted to be slid from a use position in which the top surface is substantially accessible to support the tray, to a stowed position in which the top surface is not substantially accessible to support the tray. A tray adapted to sit on and span the distance between the two extended support members may also be included.

18 Claims, 9 Drawing Sheets

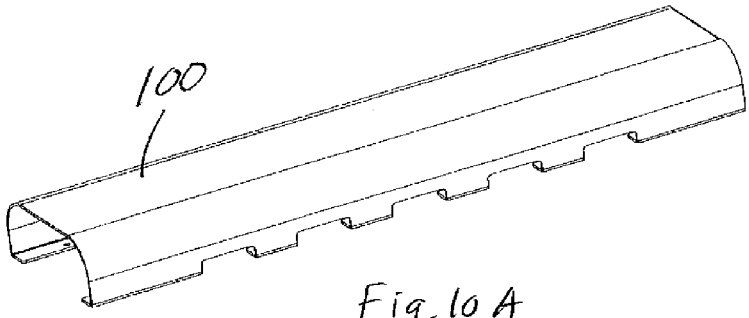
Fig. 10A
Fig. 10B
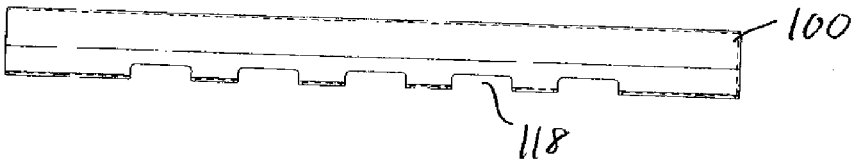
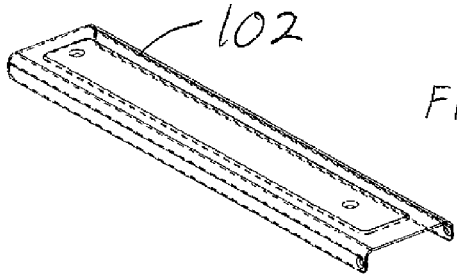
Fig. 11

WIRELESS MOUSE AND KEYBOARD CHAIR MOUNT APPARATUS

CROSS REFERENCE TO RELATED APPLICATIONS

This application claims priority of Provisional Patent Application Ser. No. 60/759,235 filed Jan. 13, 2006, the disclosure of which is incorporated herein by reference.

FIELD OF THE INVENTION

The invention relates to an apparatus attached to or integral with an armchair, for supporting computer equipment. More specifically, the invention relates to a stowable mount attached to both arms of an armchair, where the mount supports a removable tray. The tray may itself support a keyboard, a mouse, and/or a laptop computer.

BACKGROUND OF THE INVENTION

The computer has become a standard in every office and most every home. Many computer users are tied to the computer by a conventional "wired" keyboard and "wired" mouse. In the last several years, though, the wireless keyboard and wireless mouse have become increasing popular. While there are many advantages to these wireless devices, both the keyboard and the mouse must be placed on a hard surface to function properly. As a result, the wireless keyboard and mouse are typically placed on the desk or table in front of the computer monitor, as with a conventional "wired" keyboard and "wired" mouse. This same situation often occurs with laptop computers. Users are therefore forced to position themselves directly in front of the keyboard and mouse, and adjust their back and sitting position accordingly. This stationary positioning can quickly lead to fatigue and eye strain.

Ideally, the computer user would be able to easily and quickly adjust to the most comfortable and ergonomically correct position for typing and use of the mouse, potentially reducing fatigue and eye strain.

SUMMARY OF THE INVENTION

The invention accomplishes a solution to these problems, by providing after-market removable mounts, or installed, permanent mounts, for the chair arms. The mounts include slidable cantilevered members, which, when extended, may be used to support a work tray. The tray may in turn support a keyboard, a mouse, and/or a laptop computer. When not in use, the tray may be lifted off and placed on a desk or other surface, and the slidable members may be retracted out of the way.

This invention features an apparatus for supporting a tray on a chair having two arms, the apparatus comprising a first support member coupled to a first arm of the chair, the first support member defining a top surface and being adapted to be slid from a use position in which the top surface is substantially accessible to support the tray, to a stowed position in which the top surface is not substantially accessible to support the tray. The apparatus further comprises a second support member coupled to a second arm of the chair, the second support member defining a top surface and being adapted to be slid from a use position in which the top surface is substantially accessible to support the tray, to a stowed position in which the top surface is not substantially accessible to support the tray.

The first support member and/or the second support member may each comprise a cantilevered arm, and may further comprise an end cap on the distal end of the arm. The end cap may define a thumb grip to assist the user in sliding the support member. The support members may further comprise one or more spaced grips on the top surface. The support members may be generally rigid. The top surface of the support members may be generally flat.

The apparatus may further comprise a first housing for the first support member and a second housing for the second support member. The housings may be adapted to be releasably coupled to an arm of the chair. The housings are preferably adapted to be coupled such that they each sit on top of the arm to which the housing is coupled. This may be accomplished with one or more straps that are coupled to the housing and encircle the arm. The straps may be adjustable in length. The inventive apparatus may further comprise a construction for releasably locking each arm in its respective housing, which may be accomplished with a detent assembly, located in part on the support member and in part on the housing.

The inventive apparatus may further comprise a tray adapted to sit on and span the distance between the first and second support members. The tray may have an upper surface and a lower surface, and carry two pairs of channel-defining members on its lower surface. The channel-defining members may comprise spaced generally linear protrusions, which may be generally parallel to one another. The top surface of the tray is preferably large enough to support a wireless computer keyboard and a wireless computer mouse.

This invention also features an apparatus for supporting a tray on a chair having two arms, the apparatus comprising a first generally rigid, cantilevered arm support member coupled to a first arm of the chair, the first support member defining a generally flat top surface and being adapted to be slid from a use position in which the top surface is substantially accessible to support the tray, to a stowed position in which the top surface is not substantially accessible to support the tray. This embodiment of the inventive apparatus further comprises a second generally rigid, cantilevered arm support member coupled to a second arm of the chair, the second support member defining a generally flat top surface and being adapted to be slid from a use position in which the top surface is substantially accessible to support the tray, to a stowed position in which the top surface is not substantially accessible to support the tray. The apparatus may further comprise a first housing for the first support member and a second housing for the second support member, wherein the housings are adapted to be releasably coupled to an arm of the chair such that the housing sits on top of the arm to which it is coupled. The apparatus preferably also includes a tray adapted to sit on and span the distance between the first and second support members. The tray may have an upper surface and a lower surface, and carry two pairs of channel-defining members on its lower surface.

BRIEF DESCRIPTION OF THE DRAWINGS

Other objects, features and advantages will occur to those skilled in the art from the following description of the preferred embodiments of the invention, and the accompanying drawings, in which:

FIGS. 10A and 10B are perspective and side views, respectively, of the cover portion of the embodiment shown in FIGS. 8A, 8B, 9A and 9B;

FIG. 11 is a perspective view of the slide-out tray support member of the embodiment shown in FIGS. 8A, 8B, 9A and 9B;

DETAILED DESCRIPTION OF PREFERRED EMBODIMENTS OF THE INVENTION

This invention features mounts with slidable tray support members coupled to each arm of a chair that has two arms. The support members slide from a stowed position in which they are primarily or fully located beneath the top cushion of the chair arm, to an extended use position in which the support members extend outward from the arms. A tray that can hold a wireless keyboard and mouse, or a laptop computer, for example, can then be placed on the extended tray support members. The tray can be adapted to fit snugly on the extended tray support members.

The invention allows a computer user to adjust himself or herself to the most comfortable and most ergonomically-correct position for typing and use of a mouse. The invention allows the user to sit in a two-armed armchair in the normal way in which the chair is designed to be used, while at the same time offering ergonomically-correct access to a wireless mouse and keyboard or a laptop computer, for example. The invention maintains the keyboard and mouse or laptop computer in an ergonomically-correct position relative to the user even as the chair is moved.

Three different embodiments of the invention, each having slight changes to various features of the invention, are shown in FIGS. 1-12 of the drawings. These embodiments comprise after-market products that can be attached to existing standard arms of a two-armed office chair of the type shown in FIG. 7. An alternative embodiment, shown in FIG. 13, places the retractable tray support members directly into the construction of the chair, located below the cushion that comprises the top of the chair's arms.

Figure 1:
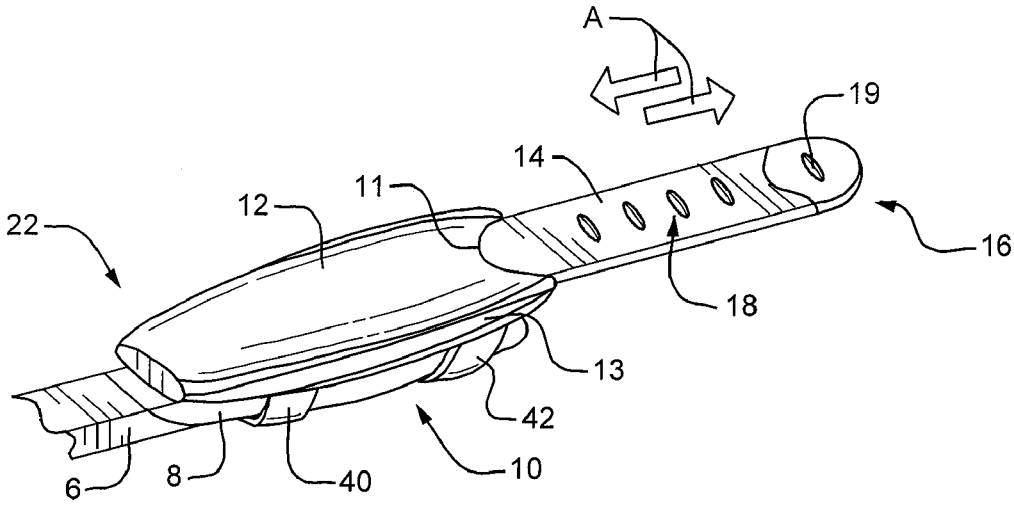
FIG. 1 shows a first embodiment of the inventive wireless mouse and keyboard chair mount apparatus of the invention, with the slidable tray support member in the extended, ready-to-use position, but without the tray.
Figure 2:
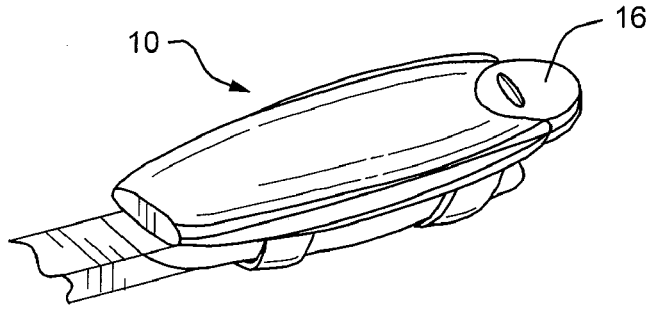
FIG. 2 shows the embodiment of FIG. 1 with the tray support member stowed.
Figure 3:
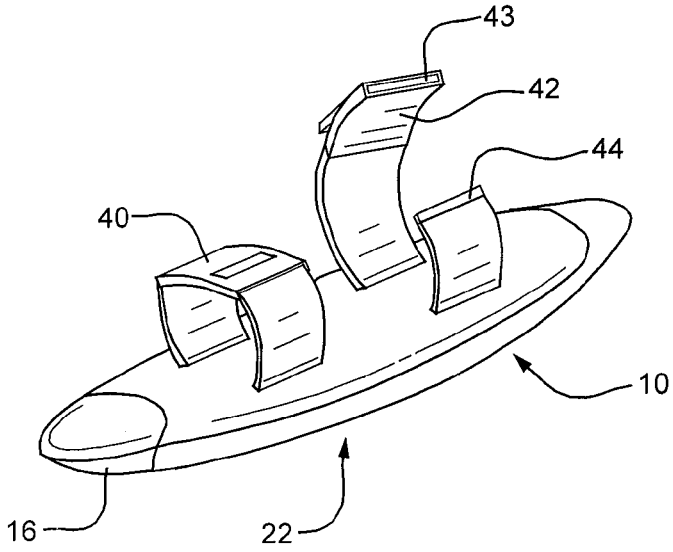
FIG. 3 shows the embodiment of FIG. 1 removed from the chair arm and turned upside-down.
Figure 4A:
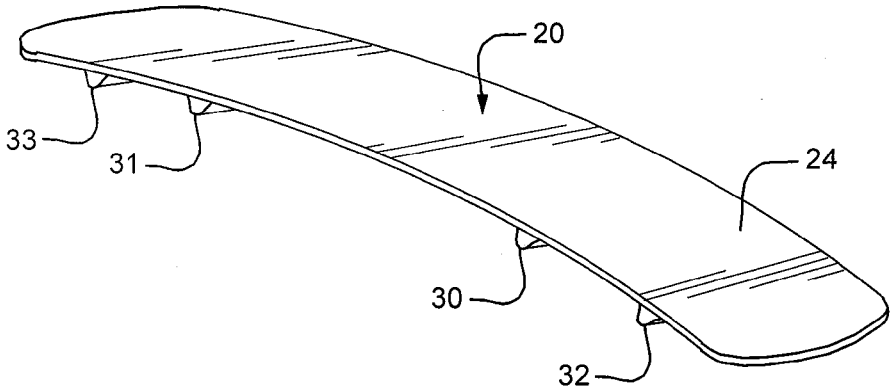
FIG. 4A shows an embodiment of the work tray for the embodiment of FIG. 1.
Figure 4B:
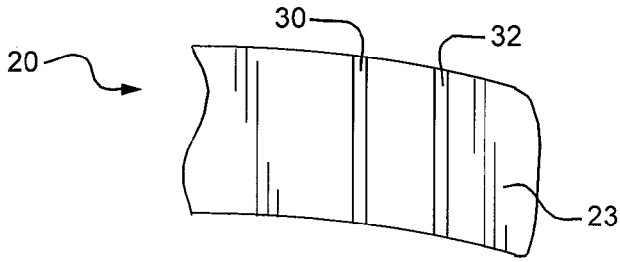
FIG. 4B is a partial, bottom view of the tray of FIG. 4A, showing a pair of channel-defining members.

Apparatus 10, FIG. 1, is adapted to be attached to chair arm 6, typically on top of arm cushion 8. Apparatus 10 includes slidable tray support member 14 that slides in and out relative to chair arm 6 in the direction of arrows A, from the extended use position shown in FIG. 1 to the stowed position shown in FIG. 2. In the extended position, the top surface of member 14 can temporarily support work tray 20 that itself can support a wireless computer keyboard and/or mouse, or a laptop computer, for example.

Figure 5:
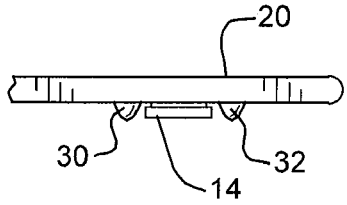
FIG. 5 is a side view of the tray of FIGS. 4A and 4B resting on an apparatus of FIGS. 1-3.
Figure 6:
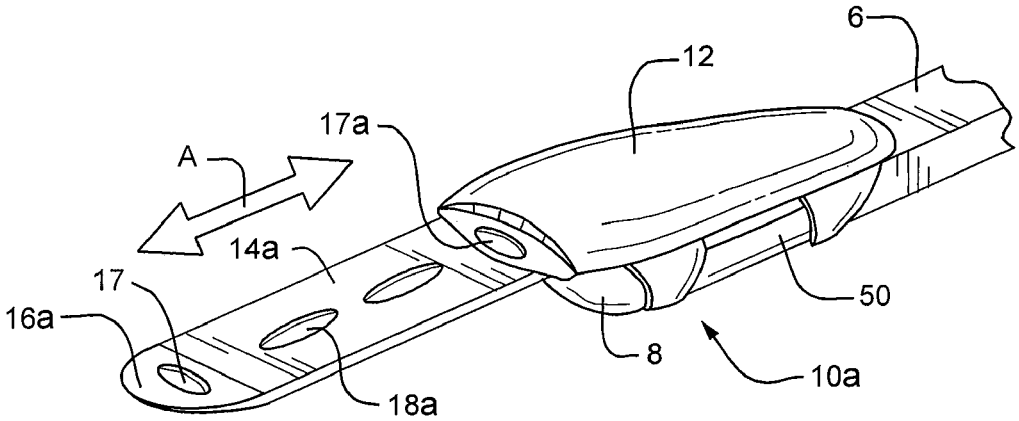
FIG. 6 shows a second embodiment of the inventive wireless mouse and keyboard chair mount apparatus of the invention, with the slidable tray support member in the extended, ready-to-use position, but without the tray.
Figure 7:
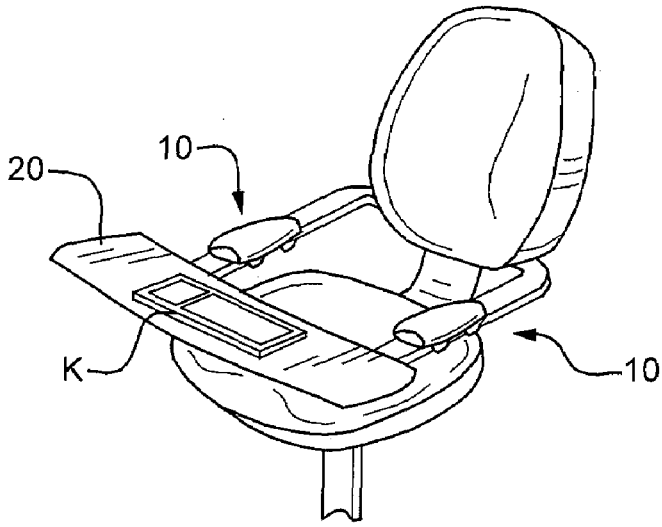
FIG. 7 shows an armchair with the invention in use thereon.
Figure 8A:
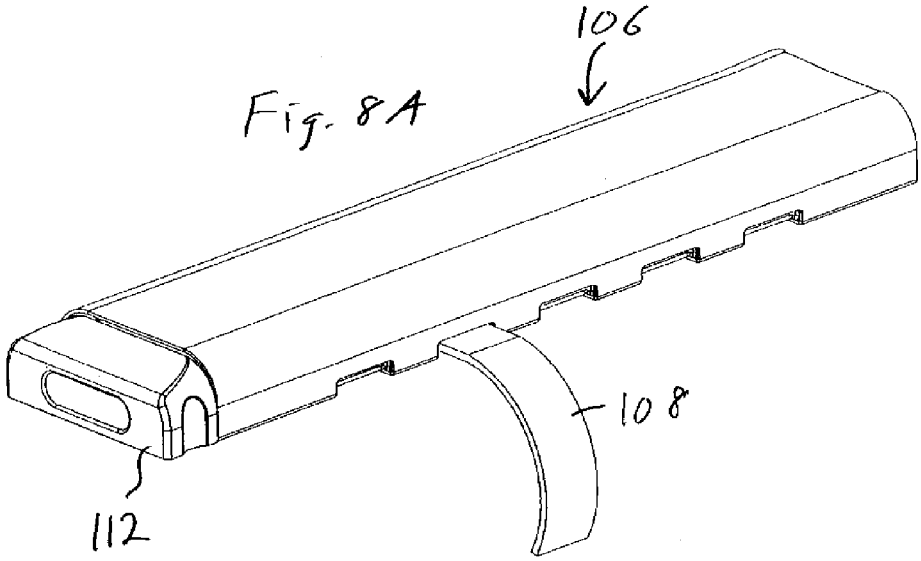
FIGS. 8A and 8B are top and bottom views, respectively, of the preferred embodiment of the inventive wireless mouse and keyboard chair mount apparatus of the invention, with the slidable tray support member in the stowed position, but without the tray.
Figure 8B:
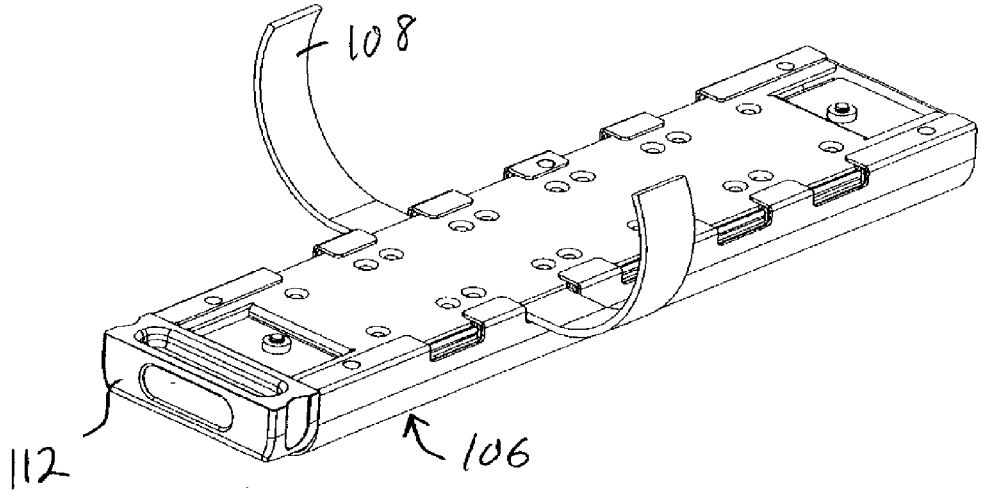
Figure 9A:
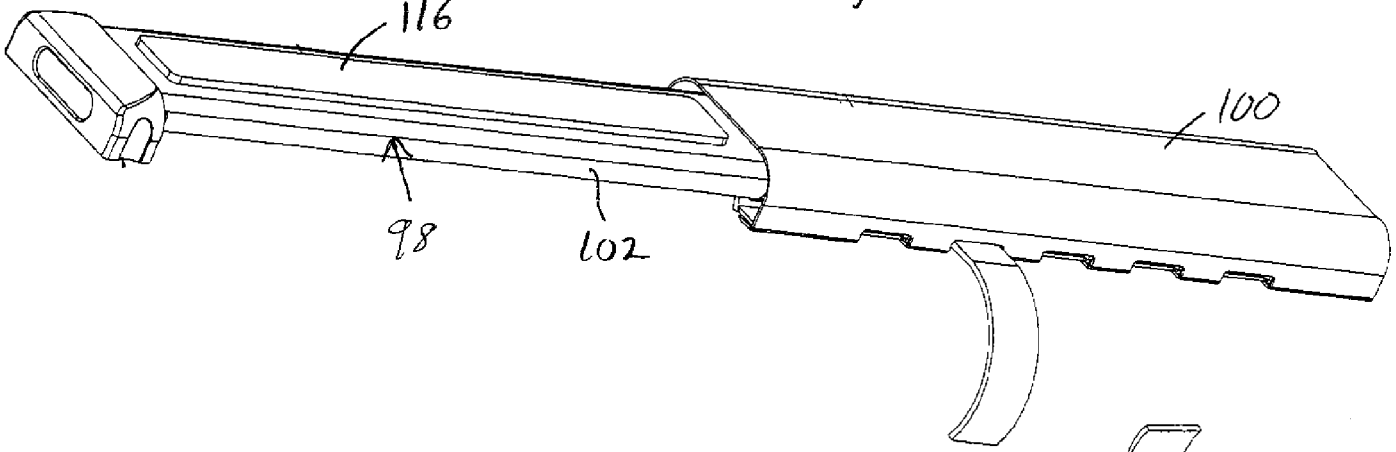
FIGS. 9A and 9B are top and bottom views, respectively, of the preferred embodiment of the inventive wireless mouse and keyboard chair mount apparatus of the invention shown in FIGS. 8A and 8B, with the slidable tray support member in the extended, ready-to-use position, but without the tray.
Figure 9B:
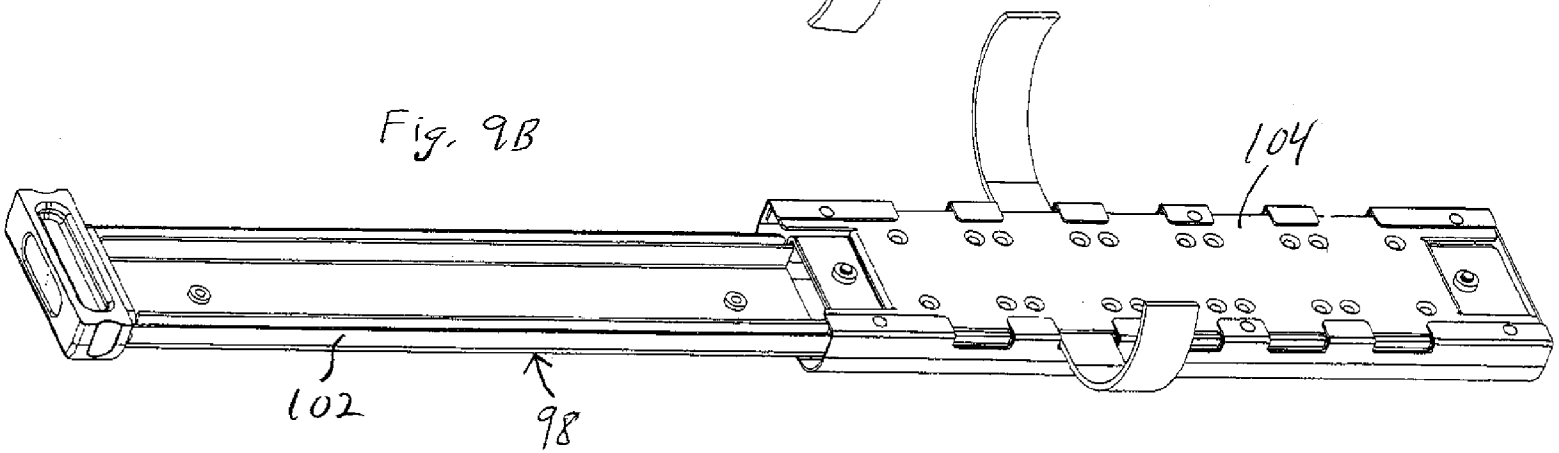
Figure 12A:
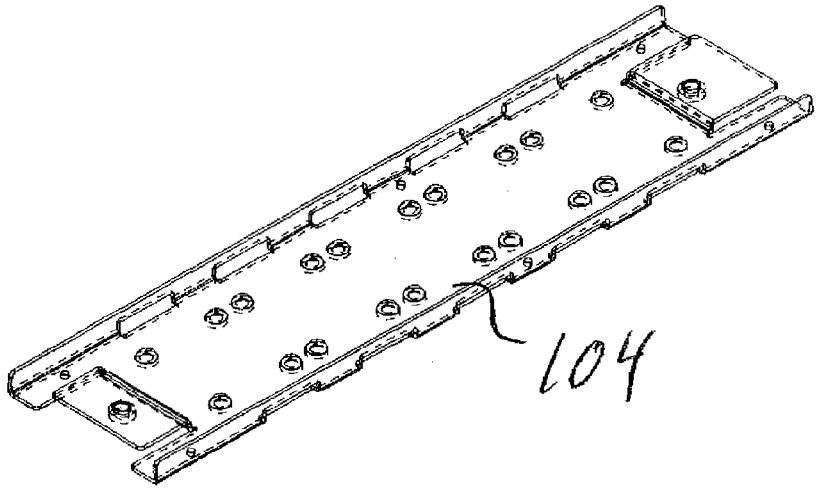
FIGS. 12A and 12B are perspective and side views, respectively, of the mount member of the embodiment shown in FIGS. 8A, 8B, 9A and 9B.
Figure 12B:
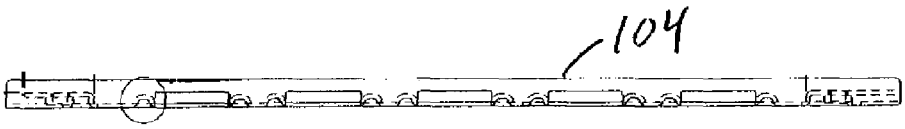

In the embodiment shown in FIGS. 1-6, work tray 20 is designed to sit down on top of two members 14, one of which is coupled to each arm of a two-arm chair, as shown in FIG. 7, with keyboard "K" on tray 20. Tray 20 is preferably designed for a positive, slip-resistant fit on two members 14 by including two properly spaced apart pairs of spaced, downwardly-extending, parallel, channel-defining members such as pair 30 and 32, and pair 31 and 33, FIG. 4A. Members 30 and 32 are also shown in FIG. 4B, and are spaced apart a sufficient distance to snugly accept the width of support member 14 between them, as shown in FIG. 5.

Tray 20 is placed down on top of the two support members. As the support members extend directly out from the chair arms, they hold the tray at substantially the height of the chair arms. By extending support members 14 out a desired distance from the chair arms, and potentially by adjusting the height of the chair arms as desired, the user can place the tray (and thus the keyboard and mouse sitting on the tray) at a desired, comfortable, ergonomic position relative to the user sitting in the chair. The user can move the chair, for example by pivoting the chair or leaning back in the chair, and the keyboard, mouse and/or laptop computer or other equipment placed on the tray will maintain itself in the same desired position relative to the user. This is particularly attractive when using a wireless keyboard and mouse in an office or home environment.

Member 14 can have several spaced grips 18 that help to grip the work tray. Soft end cap 16 with thumb grip 19 serves as the grip for the user to pull member 14 out from housing 13 to the use position as shown in FIG. 1, and to push member 14 back into housing 13 to the stowed position shown in FIG. 2.

The fixed portion 22 of apparatus 10 preferably comprises detents or other mechanical structures for maintaining the support members in the partially or fully extended, or retracted positions, with a minimal force needed to override the detent. One example of a detent is shown in FIG. 6A.

The after market devices shown in FIGS. 1-12 need to mount to the chair arms in some fashion. One non-limiting example is shown, in which adjustable straps 40 and 42 are included on the underside of the fixed portion 22 of the inventive apparatus, and are designed to wrap around the existing chair arms. Straps 40 and 42 can be made adjustable in length and/or of two releasable portions, so that portion 22 can be coupled to the arm of a chair. This can be accomplished with hook and loop fastener-type straps, or straps with buckles or D-ring-type length adjustments, or the like. This allows the invention to be added to or removed from a chair as desired. Another more permanent mounting option, not shown in the drawings, could be accomplished by including one or more patches or strips of a hook and loop-type fasteners such as Velcro™ to the top of the chair arms and mating portions of the Velcro™ on the bottom of the fixed portion of the inventive apparatus. Other mounting solutions would be apparent to those skilled in the art.

FIG. 6 shows a slightly different potential construction of grips 18*a* and end cap 16*a*, as well as a concept for a detent comprising receiving member 17 and push-button operated projecting detent member 17*a*. Detents to releasably maintain a movable member relative to a fixed member are well known, and any reasonable detent solution can be used should such be desired.

Figure 6A:
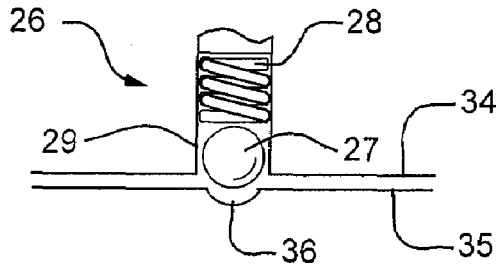
FIG. 6A is a simplified schematic cross-sectional view of a detent mechanism for the invention.

One non-limiting example of a simple ball detent mechanism that can be used with the invention is shown in FIG. 6A. Detent mechanism 26 is of the type that is released by force applied to the moving tray support member. Ball 27 slides within housing 29 against the pressure of spring 28. Ball 27 extends slightly lower than bottom surface 34 of portion 22, and fits partially into recess 36 in the top surface 35 of tray support member 14. This releasably fixes member 14 relative to fixed portion 22. One or more recesses such as recess 36 can be spaced along top surface 35 to create predefined stop positions; typically there are at least two such recesses, one to define a stowed position and one to define a fully deployed position of tray support member 14.

A preferred embodiment of the invention is shown as apparatus 106, FIGS. 8 through 12. Apparatus 106 comprises external cover portion 100 which defines a series of spaced slots that accommodate one or more straps such as strap 108. Slide-out tray support member 98 comprises slide-out member 102 and pad or cushion 116. Mount member 104 for slide member 102 is also shown. Member 102 may have pad or grip 110 on its top surface so that it can hold a tray in a manner that helps to prevent the tray from sliding relative to the member. End cap 112 provides a grip that allows the slide member to be manipulated from the open or use position to the closed position, and vice versa. One or more straps 108 are threaded from side to side of member 100 in a set of gaps 118 made for this purpose. The provision of multiple sets of gaps allows one or more straps to be placed in desired locations along the length of the assembly so that it can be accepted onto different styles and models of chairs with different configurations of arm rests.

In one prototype of the invention, the bottom of tray 20 has Velcro™ patches 21 that mate with Velcro™ portions 15 on the tops of members 14. This arrangement allows the tray to be placed in various locations along the length of members 14.

Figure 13A:
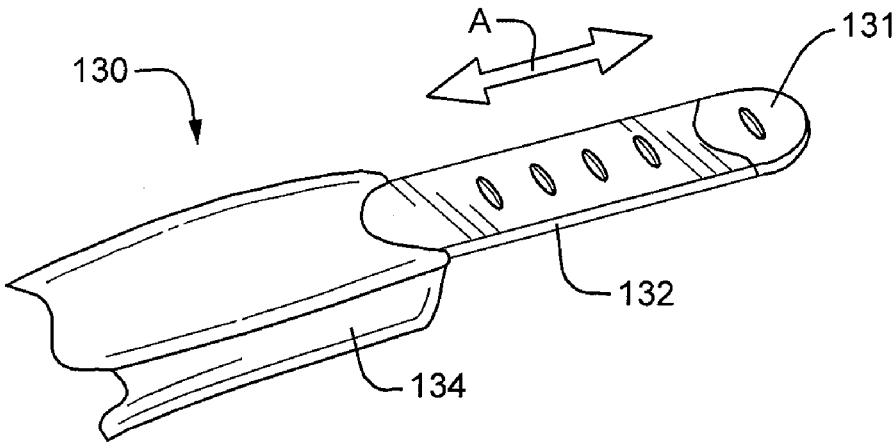
FIG. 13A is a view similar to FIG. 1A of another embodiment of the invention that is built directly in to the arms of an armchair.
Figure 13B:
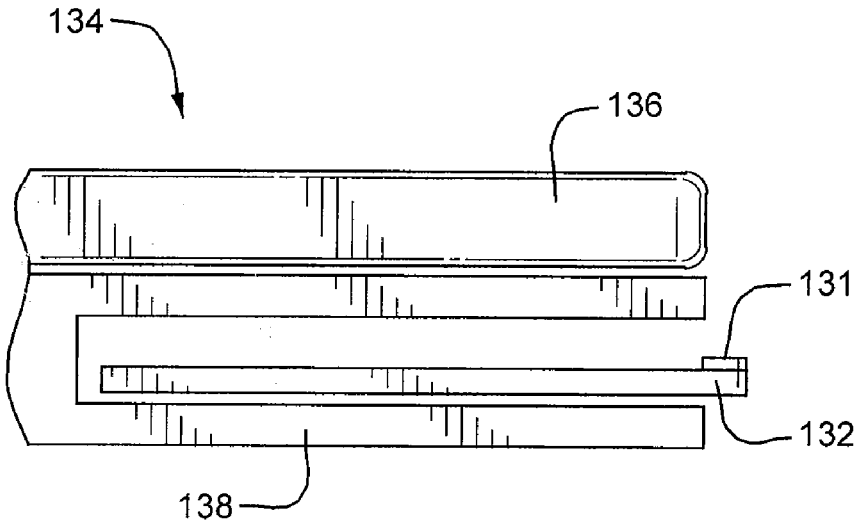
FIG. 13B is a cross-sectional view of the embodiment of FIG. 13A.

FIGS. 13A and 13B depict a permanently-installed embodiment 130 of the invention, in which slidable tray support member 132 slides into and out of chair arm 134 in the directions of arrow A. Embodiment 130 can be accomplished with a construction that is largely similar to those described above, but accomplishing a housing similar to apparatus 106. In this case, the apparatus does not need a top cushion, as the normal top cushion 136 of arm 134 of the armchair is still available. For example, housing 138 for support member 132 with end-cap 131 lies below chair arm top cushion 136. Housing 138 is an integral part of the construction of chair arm 134 in this embodiment.

Although specific features of the invention are shown in some figures and not others, this is for convenience only, as some features may be combined with any or all of the other features in accordance with the invention.

Recitation of ranges of values herein are merely intended to serve as a shorthand method of referring individually to each separate value falling within the range, unless otherwise indicated herein, and each separate value is incorporated into the specification as if it were individually recited herein.

The use of any and all examples, or exemplary language (e.g., "such as") provided herein, is intended merely to better illustrate the invention and does not pose a limitation on the scope of the invention, A variety of modifications to the embodiments described herein will be apparent to those skilled in the art from the disclosure provided herein. Thus, the invention may be embodied in other specific forms without departing from the spirit or essential attributes thereof.

What is claimed is:

1. An apparatus for supporting a tray on a chair having two arms, the apparatus comprising:

a first support member coupled to a first arm of the chair, the first support member defining a top surface and being adapted to be slid from a use position in which the top surface is substantially accessible to support the tray, to a stowed position in which the top surface is not substantially accessible to support the tray;

a second support member coupled to a second arm of the chair, the second support member defining a top surface and being adapted to be slid from a use position in which the top surface is substantially accessible to support the tray, to a stowed position in which the top surface is not substantially accessible to support the tray; and a first housing for the first support member and a second housing for the second support member, wherein the housings are adapted to be releasably coupled to an arm of the chair.

2. The apparatus of claim 1 wherein the first support member comprises a cantilevered arm.

3. The apparatus of claim 2 wherein the first support member further comprises an end cap on the distal end of the arm.

4. The apparatus of claim 3 wherein the end cap defines a thumb grip to assist the user in sliding the first support member.

5. The apparatus of claim 2 wherein the first support member further comprises one or more spaced grips on the top surface, to assist in supporting the tray on the first Support member.

6. The apparatus of claim 1 wherein the first support member is generally rigid.

7. The apparatus of claim 1 wherein the top surface of the first support member is generally flat.

8. The apparatus of claim 1 wherein the housings are adapted to be coupled to an arm of the chair such that the housing sits on top of the arm to which it is coupled.

9. The apparatus of claim 8 wherein the housing are coupled to an arm of the chair by one or more straps that are coupled to the housing and encircle the arm.

10. The apparatus of claim 9 wherein the straps are adjustable in length.

11. The apparatus of claim 1 further comprising a construction for releasably locking each arm in its respective housing.

12. The apparatus of claim 11 wherein the construction for releasably locking each arm in its respective housing comprises a detent assembly, located in part on the support member and in part on the housing.

13. The apparatus of claim 1 further comprising a tray adapted to sit on and span the distance between the first and second support members.

14. The apparatus of claim 13 wherein the tray has an upper surface and a lower surface, and carries two pairs of channel-defining members on its lower surface for accepting the support members.

15. An apparatus for supporting a tray on a chair having two arms, the apparatus comprising:

a first support member coupled to a first arm of the chair, the first support member defining a top surface and being adapted to be slid from a use position in which the top surface is substantially accessible to support the tray, to a stowed position in which the top surface is not substantially accessible to support the tray;

a second support member coupled to a second arm of the chair. the second support member defining a top surface and being adapted to be slid from a use position in which the top surface is substantially accessible to support the tray, to a stowed position in which the top surface is not substantially accessible to support the tray; and a tray adapted to sit on and span the distance between the first and second support members, wherein the tray has an upper surface and a lower surface. and carries two pairs of channel-defining members on its lower surface for accepting the support members, wherein the channel-defining members comprise spaced generally linear protrusions.

16. The apparatus of claim 15 wherein the linear protrusions of each pair are generally parallel to one another.

17. The apparatus of claim 15 wherein the top surface of the tray is large enough to support a wireless computer keyboard and a wireless computer mouse.

18. An apparatus for supporting a tray on a chair having two arms, the apparatus comprising:

a first generally rigid, cantileyered arm support member coupled to a first arm of the chair, the first support member defining a generally flat top surface and being adapted to be slid from a use position in which the top surface is substantially accessible to support the tray, to a stowed position in which the top surface is not substantially accessible to support the tray; and a second generally rigid, cantilevered arm support member coupled to a second arm of the chair, the second support member defining a generally flat top surface and being adapted to be slid from a use position in which the top surface is substantially accessible to support the tray, to a stowed position in which the top surface is not substantially accessible to support the tray;

a first housing for the first support member and a second housing for the second support member, wherein the housings are adapted to be releasably coupled to an arm of the chair such that the housing sits on top of the arm to which it is coupled; and a tray adapted to sit on and span the distance between the first and second support members, wherein the tray has an upper surface and a lower surface, and carries two pairs of channel-defining members on its lower surface for accepting the support members.

* * * * *